US006164849A

United States Patent [19]

Koyama

[11] Patent Number: 6,164,849

[45] Date of Patent: Dec. 26, 2000

[54] GLOSS CONTROL APPARATUS AND METHOD

[75] Inventor: Noboru Koyama, Kanagawa, Japan

[73] Assignee: Sony Corporation, Tokyo, Japan

[21] Appl. No.: 09/139,888

[22] Filed: Aug. 25, 1998

[30] Foreign Application Priority Data

Aug. 27, 1997 [JP] Japan ..... 9-231230
Aug. 27, 1997 [JP] Japan ..... 9-231232

[51] Int. Cl.[7] ..... B41J 2/315
[52] U.S. Cl. ..... 400/120.01
[58] Field of Search ..... 400/120.01

[56] References Cited

U.S. PATENT DOCUMENTS 5,521,688 5/1996 Moser ..... 355/285
5,633,670 5/1997 Kwak ..... 347/188
5,859,933 1/1999 Sasanuma et al. ..... 382/275

FOREIGN PATENT DOCUMENTS 0524245 2/1993 Japan .
6-186882 7/1994 Japan .
06218968 8/1994 Japan .
0752428 2/1995 Japan .
11-119484 4/1999 Japan .

*Primary Examiner*—John S. Hilten
*Assistant Examiner*—Charles H. Nolan, Jr.
*Attorney, Agent, or Firm*—Jay H. Maioli

[57] ABSTRACT

A gloss control apparatus and a gloss control method for achieving even glossiness of an image recording surface of a heat-sensitive recording medium on which an image has been recorded and for controlling the glossiness as desired. In addition, process time and thermal energy required for achieving even glossiness are reduced. A CPU determines thermal energy corresponding to a desired glossiness based on gloss characteristic information about thermal energy and glossiness of the recording medium stored in the internal memory. The CPU controls a thermal head through a head controller so that the determined thermal energy is evenly applied to all over the image recording surface of the medium on which the image has been recorded. Evenness of glossiness of the medium after image recording is thus achieved so that the glossiness the user desires is obtained.

6 Claims, 9 Drawing Sheets

GLOSS CONTROL APPARATUS AND METHOD

BACKGROUND OF THE INVENTION

1. Field of the Invention

The present invention relates to a gloss control apparatus and a gloss control method of controlling glossiness of an image recording surface of a heat-sensitive recording medium that develops at least one color in response to an application of thermal energy.

2. Description of the Related Art

Various methods have been developed for recording information such as texts and images, including electrophotography, ink-jet printing and thermal printing. The thermal printing utilizes a heat-sensitive recording medium made of a base material such as paper or synthetic paper to which a coupler or a developer is applied. Thermal energy is applied to the medium by means of a thermal head and the like so that the medium develops a color. An image is thereby recorded on the medium. The thermal printing has advantages in that no development is required as for photography, the density of a color is high and a high-contrast image is obtained and so on. The further advantage is that thermal printing is implemented with a recording apparatus of simple configuration at a low cost. The thermal printing has been therefore widely used in the fields of black-and-white facsimiles, printers and so on.

Although heat-sensitive recording media for black-and-white image printing have been mainly used for the thermal printing, media has been further developed for multicolor image printing including full-color printing. Such a heat-sensitive recording medium for multicolor printing includes a plurality of layers that develop colors different from each other. For example, the medium is made up of a base material to a side of which three color developing layers are stacked. The layers develop a cyan, a magenta and a yellow, respectively. The layers develop colors in response to thermal energy belonging to the different energy ranges. The upper layer responds to higher thermal energy for developing a color, that is, the thermal energy for developing a color increases in the order of the yellow layer, the magenta layer and the cyan layer, for example. The density of developed color increases with an increase in thermal energy within the range of energy for developing each color.

Through the use of a heat-sensitive recording medium for multicolor printing as described above, a long-life multicolor image is obtained, having excellent hues and color separation that are difficult to obtain with prior-art techniques. Another excellent effect is that an image obtained may be turned to a transmission image or a reflection image.

In an image recording method utilizing such a heat-sensitive recording medium, thermal energy to applied is varied depending on an image to record. It is known that a difference in glossiness results on an image recording surface of the medium depending on thermal energy applied. In particular, there is a great difference between part where thermal energy is applied and the other part, that is, between part where an image is actually recorded and part where no image is recorded. Glossiness may vary in part where an image is recorded, too, from place to place, since applied thermal energy varies depending on differences in density and color. In the image recording method utilizing a heat-sensitive recording medium as thus described, uneven glossiness results all over the image recording surface after image recording. Reproducibility of the image is thereby affected. It is therefore desirable to overcome such uneven glossiness.

Techniques for improving such uneven glossiness of a heat-sensitive recording medium are disclosed in Japanese Patent Application Laid-open Nos. 5-24245 (1993) and 6-218968 (1994), for example. In the former one, a technique is disclosed for applying the highest of thermal energy applied to a color developing layer on which image recording is already performed to at least part where the color density is zero. The difference in glossiness between the part where the image is actually recorded and the part where no image is recorded is thereby reduced so that even glossiness is achieved. In the latter one, a technique is disclosed for applying heat and pressure to a heat-sensitive medium by a heat roller after image recording on the medium is completed. The difference in glossiness between the part where the color density is high (where high thermal energy is applied) and the part where the color density is low (where low thermal energy is applied) is thereby reduced so that even glossiness is achieved. As thus described, the techniques for mainly improving uneven glossiness of the heat-sensitive recording medium are disclosed in those publications.

According to the techniques, however, glossiness whose evenness has been achieved is automatically determined by the setting of the apparatus. It is not always possible to achieve glossiness as the user desires. For example, although the foregoing related-art techniques achieve even glossiness, whether glossiness improves or not is not disclosed. In some cases, even glossiness of worse quality may be obtained. In general, the user does not need such evenness that deteriorates glossiness but prefers an improvement in glossiness as well as evenness.

In the related-art techniques described above, it is difficult to precisely control thermal energy applied for achieving even glossiness since a heat roller is used as a heat application means. For example, thermal energy more than required may be applied. Achieving precisely even glossiness is thus affected. Since no specific thermal energy necessary and sufficient for achieving even glossiness is disclosed, power more than required may be consumed.

SUMMARY OF THE INVENTION

It is an object of the invention to provide a gloss control apparatus and a gloss control method for achieving even glossiness on an image recording surface of a heat-sensitive recording medium on which an image has been recorded and for controlling glossiness as desired.

A gloss control apparatus of the invention comprises: an application means for applying thermal energy and pressure to the information recording surface of the medium on which information is recorded; and a control means for controlling the thermal energy applied by the application means. The control means controls the thermal energy applied by the application means based on gloss characteristics of the medium so that desired glossiness of the information recording surface on which the information is recorded is obtained.

A gloss control method of the invention comprises the steps of: determining thermal energy to be applied to the information recording surface based on gloss characteristics of the medium so that desired glossiness of the information recording surface on which the information is recorded is obtained; and controlling the thermal energy applied to the information recording surface on which the information is recorded so that the determined thermal energy is applied to the information recording surface.

According to the gloss control apparatus of the invention, the application means applies thermal energy and pressure to the information recording surface of the medium on which information is recorded. The control means controls the thermal energy applied by the application means based on gloss characteristics of the medium so that desired glossiness of the information recording surface on which the information is recorded is obtained.

According to the gloss control method of the invention, thermal energy to be applied to the information recording surface is determined based on gloss characteristics of the medium so that desired glossiness of the information recording surface on which the information is recorded is obtained. The thermal energy applied to the information recording surface on which the information is recorded is controlled so that the determined thermal energy is applied to the information recording surface.

Other and further objects, features and advantages of the invention will appear more fully from the following description.

DETAILED DESCRIPTION OF THE PREFERRED EMBODIMENT

A preferred embodiment of the invention will now be described in detail with reference to the accompanying drawings.

Figure 6:
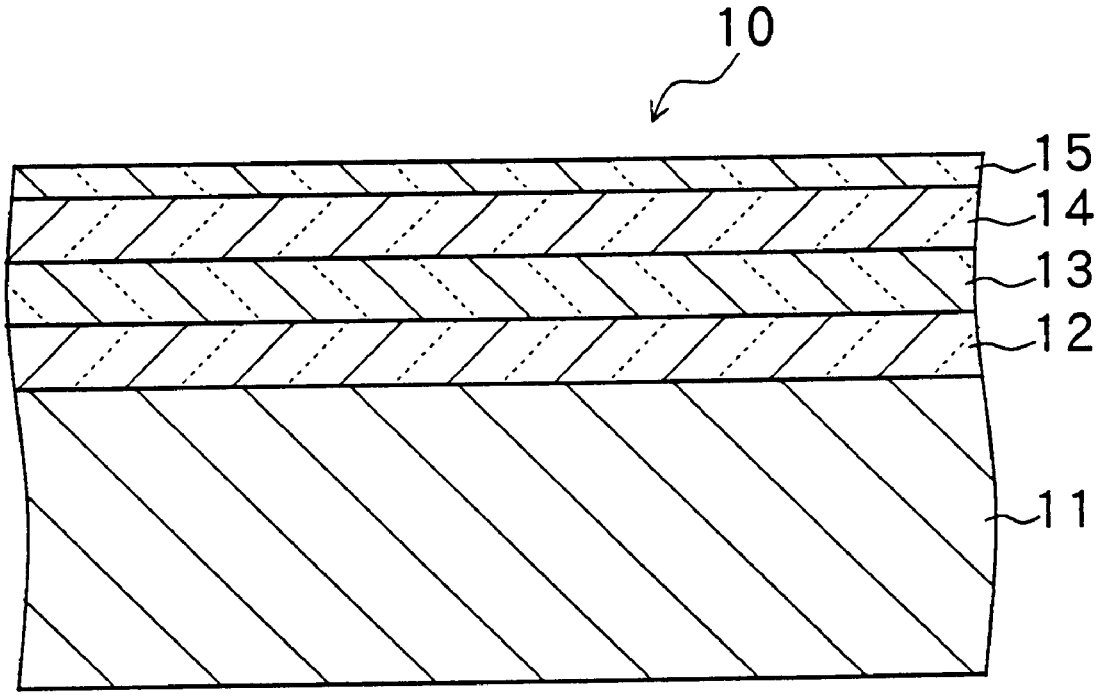
FIG. 6 is a schematic cross section for illustrating the heat-sensitive recording medium used in the image recording apparatus of the embodiment of the invention.

Reference is made to FIG. 6 for describing a heat-sensitive recording medium 10 used in an image recording apparatus of an embodiment of the invention.

The heat-sensitive recording medium 10 shown in FIG. 6 is a multicolor recording medium provided for full-color printing. The medium 10 may comprise a base material 11 made of polyethylene-laminated bond paper or wood free paper. On a side of the base material 11, a cyan layer 12, a magenta layer 13 and a yellow layer 14 are stacked, each developing a color of cyan magenta and yellow, respectively. A heat-resistant protection layer 15 is further stacked on the top layer. Of the layers of the medium 10, the cyan layer 12, the magenta layer 13, the yellow layer 14 and the protection layer 15 are all transparent. The base material 11 may be made of substantially transparent medium, too.

The magenta layer 13 and the yellow layer 14 are heat-sensitive color developing layers of photo-fixation type. The cyan layer 12 is a dye-type color developing layer. The magenta layer 13 and the yellow layer 14 may include microcapsulated diazonium salt compound and a coupler consisting of phenol compound and so on. On an application of thermal energy, permeability of microcapsulated diazonium salt compound increases and the diazonium salt compound reacts to the coupler to form an azo pigment. The magenta layer 13 and the yellow layer 14 thus develop colors. Diazonium salt compound absorbs light such as ultraviolet rays and is decomposed and loses reactivity to the coupler. The developed color is therefore fixed by radiation of light such as ultraviolet rays. For example, the color developed in the magenta layer 13 is fixed by radiation of light whose wavelength is 365 nm. The color developed in the yellow layer 14 is fixed by radiation of light whose wavelength is 420 nm. The color and density thereof will not change with a further application of thermal energy.

The heat-sensitive recording medium 10 develops different colors in response to applied thermal energy. That is, the ranges of thermal energy required for developing a color in the layers 12 to 14 of the medium 10 are different from each other. In addition, the layers 12 to 14 each develop a color of different density depending on thermal energy.

Figure 7:
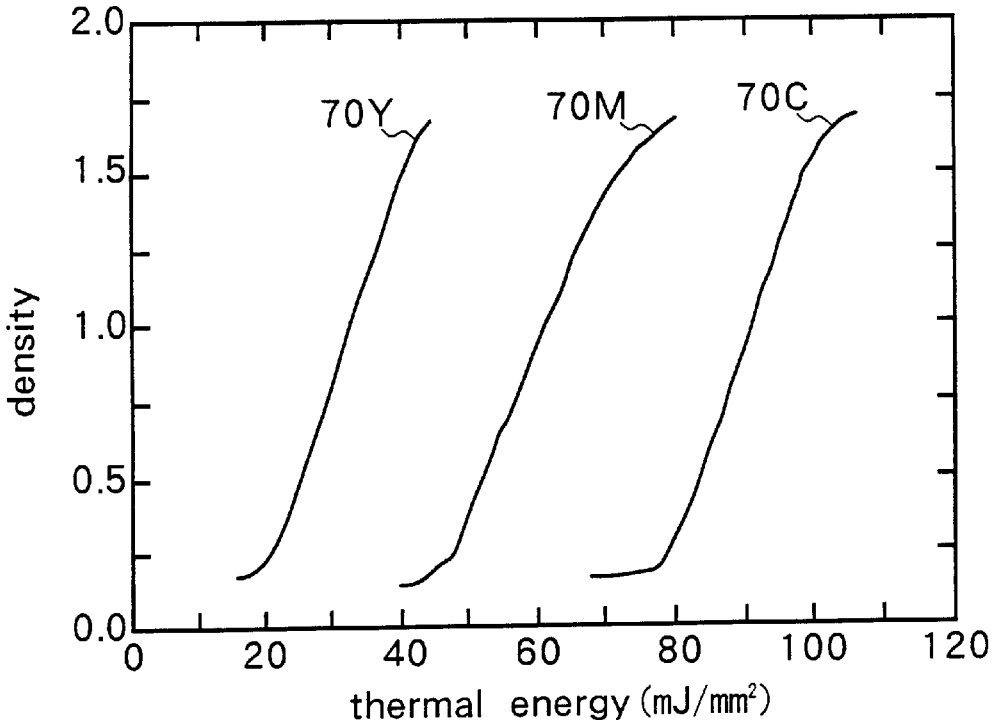
FIG. 7 is a plot for showing coloring characteristics of the heat-sensitive medium shown in FIG. 6.

FIG. 7 is a plot for showing an example of color developing characteristics of the medium 10. Graphs indicated with reference numerals 70Y, 70M and 70C each represent a color developing characteristic of the yellow layer 14, the magenta layer 13 and the cyan layer 12, respectively. As shown, the ranges of thermal energy required for developing a color in the layers 12 to 14 are different from each other. Thermal energy required for developing a color increases in the order of the yellow layer 14, the magenta layer 13 and the cyan layer 12. Within the thermal energy ranges for developing a color in the layers 12 to 14, higher thermal energy effects a higher density of developed color.

In order to record an image on the medium with the properties described above in practice, colors are developed in the order started from the one that requires the lowest thermal energy, that is, in the order of the yellow layer 14, the magenta layer 13 and the cyan layer 12. It is noted that after the yellow layer 14 develops a color, light of a specific wavelength is applied so as to fix the color of yellow before applying thermal energy for the magenta layer 13. As a result, re-development of yellow with an application of thermal energy for the magenta layer 13 and the cyan layer 12 is prevented. Similarly, after the magenta layer 13 develops a color, light of a specific wavelength is applied so as to fix the color of magenta before applying thermal energy for the cyan layer 12. As a result, re-development of magenta with an application of thermal energy for the cyan layer 12 is prevented. In general, fixation of cyan is not performed since thermal energy is no more applied for developing another color. As thus described, when an image is recorded on the medium 10, glossiness varies from place to place on the image recording surface since thermal energy applied to the surface varies depending on the image. Uneven glossiness thus results. However, such unevenness of glossiness of the medium 10 is improved by an image recording apparatus 1 of the embodiment that allows a further application of desired thermal energy to the image recording surface on which the image has been recorded as described below.

The image recording apparatus 1 of the embodiment of the invention for recording an image on the medium 10 with the structure described above will now be described. A gloss control apparatus and a method of the invention that are implemented with the apparatus 1 will be described as well.

Figure 1:
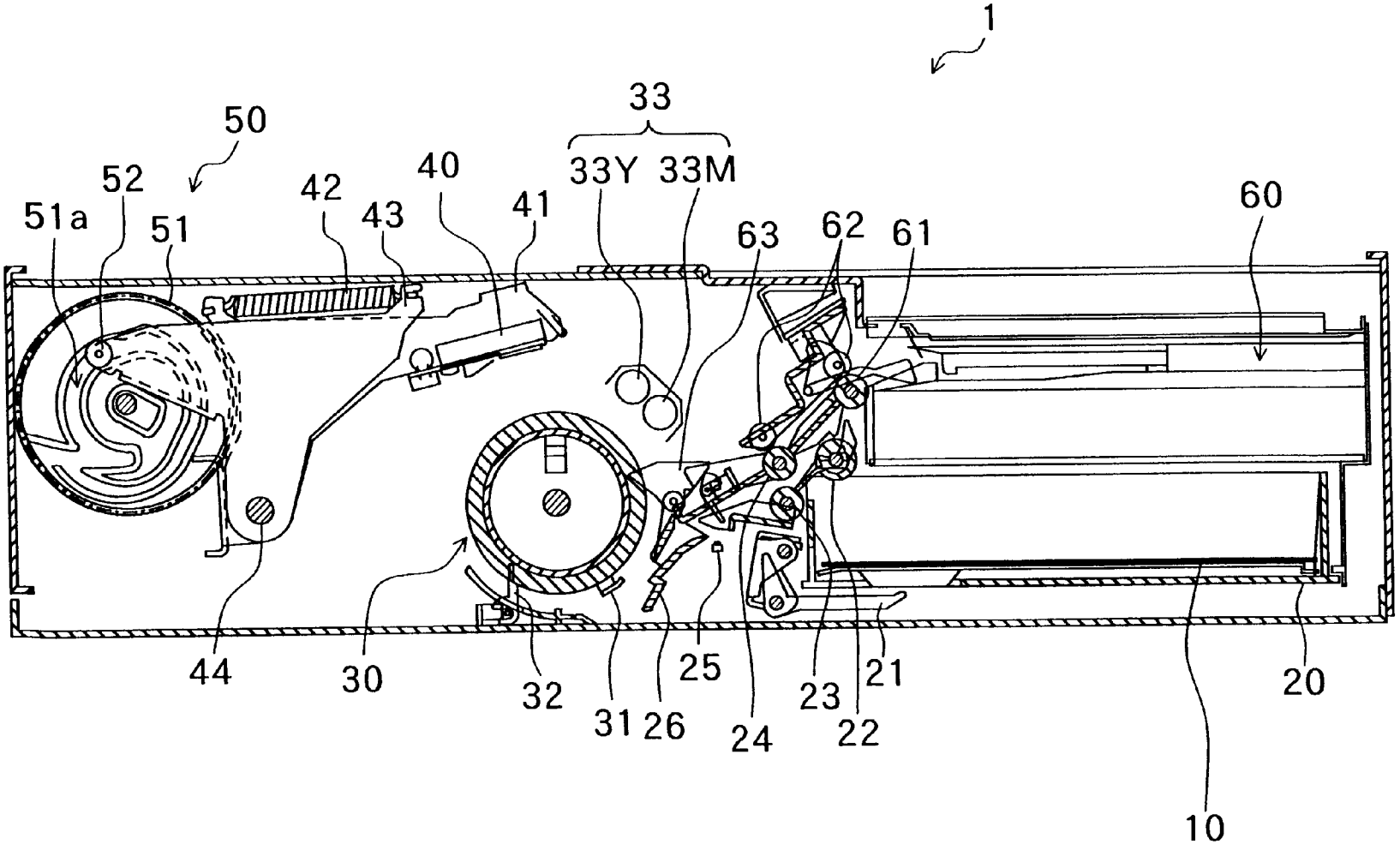
FIG. 1 is a schematic cross section for illustrating an image recording apparatus of an embodiment of the invention in an initial status.
Figure 2:
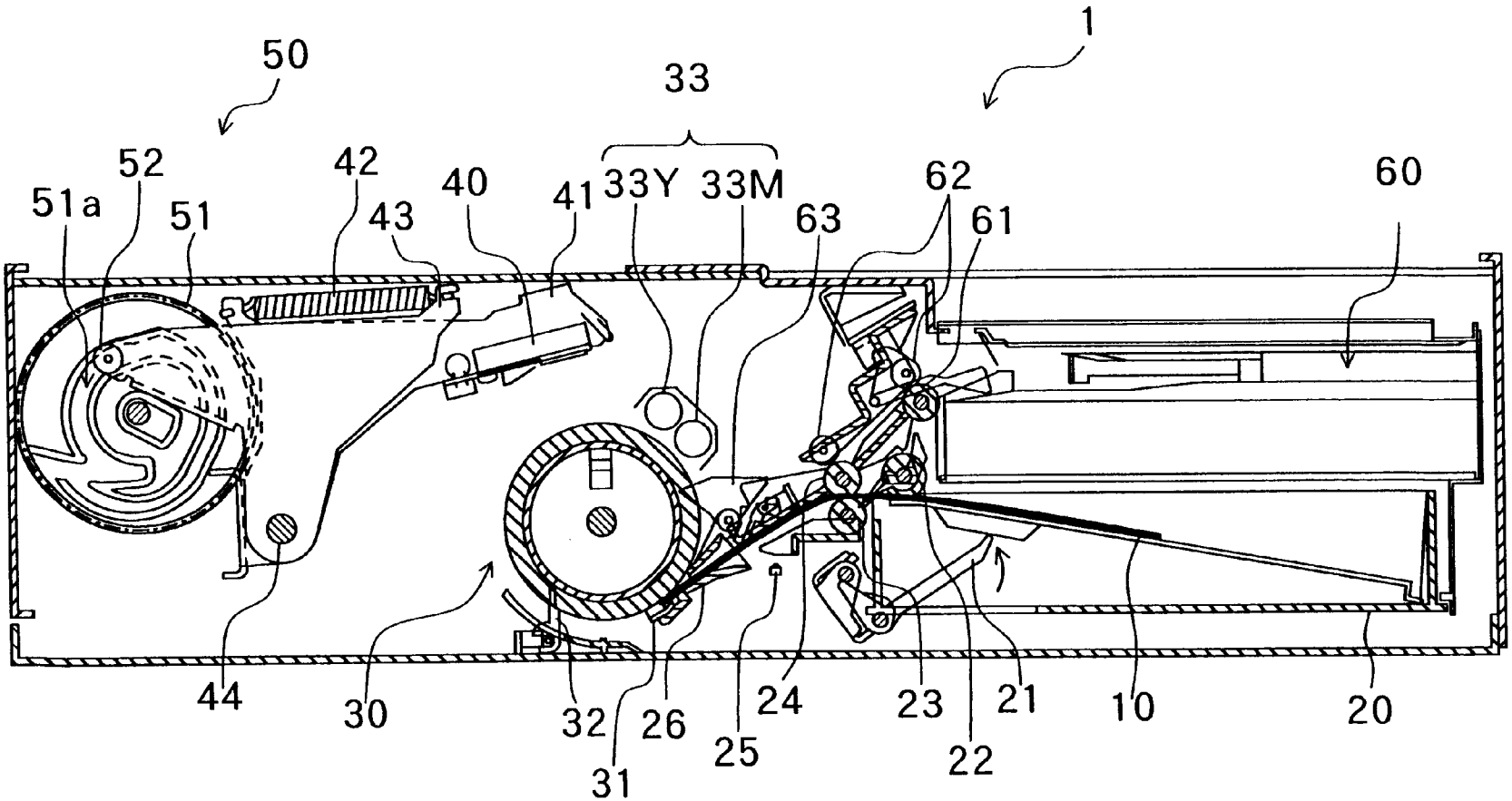
FIG. 2 is a schematic cross section for illustrating the image recording apparatus of the embodiment of the invention in a status in the step of supplying a heat-sensitive medium.
Figure 3:
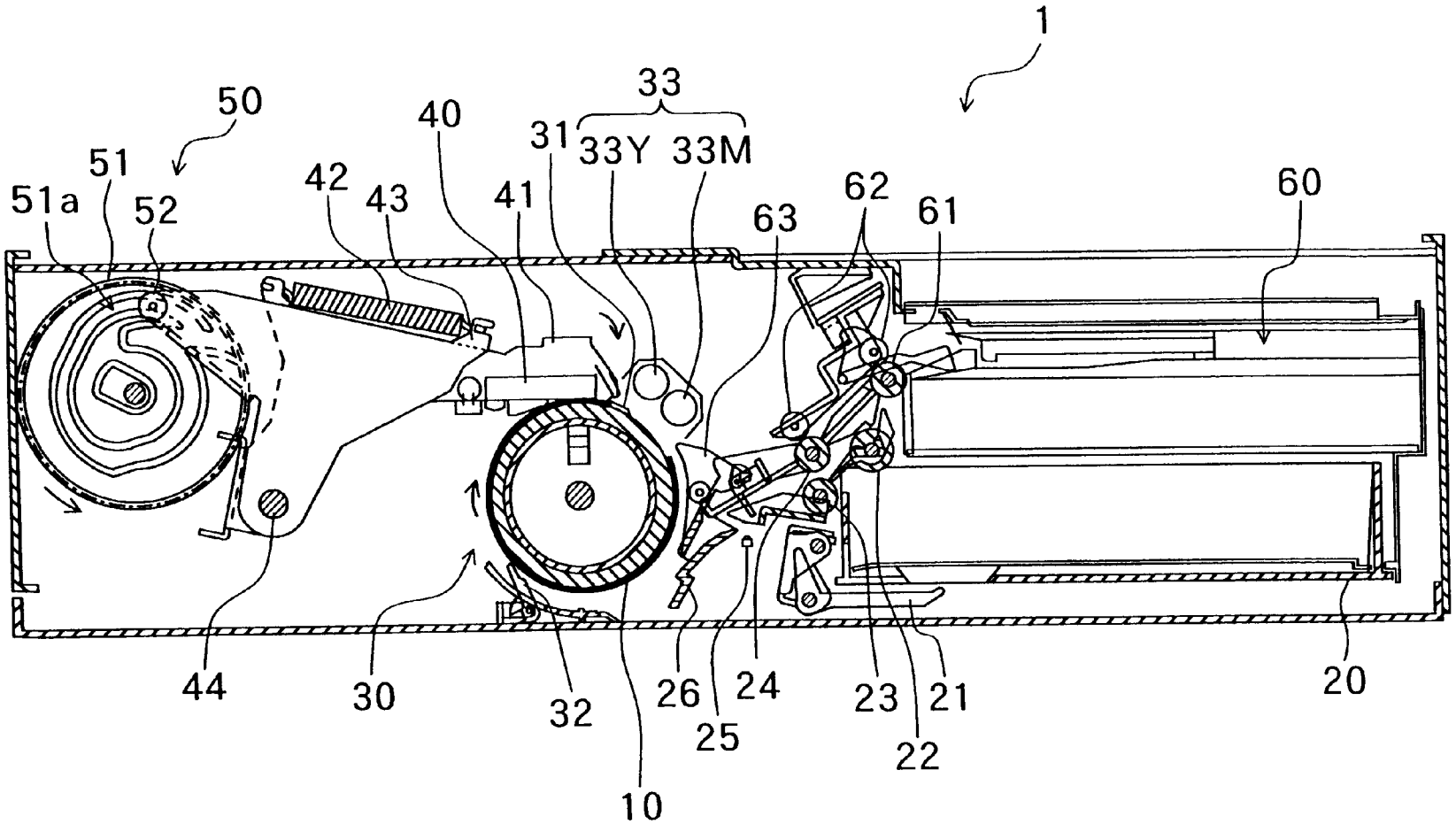
FIG. 3 is a schematic cross section for illustrating the image recording apparatus of the embodiment of the invention in a status in the step of recording an image on the medium.
Figure 4:
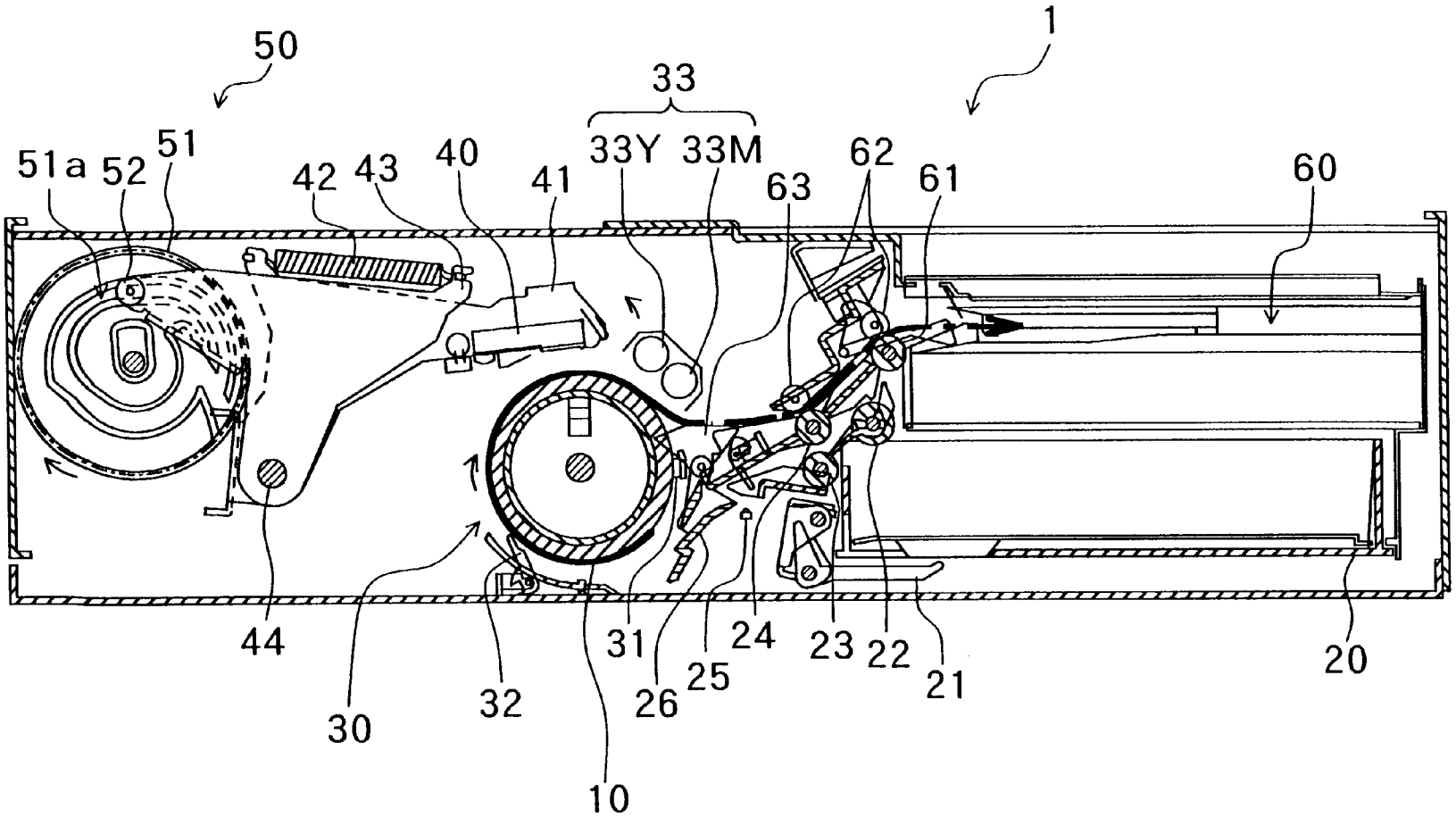
FIG. 4 is a schematic cross section for illustrating the image recording apparatus of the embodiment of the invention in a status in the step of discharging the medium.

FIG. 1 to FIG. 4 are cross sections for describing internal mechanical components of the apparatus 1 of the embodiment. FIG. 1 shows an initial status preceding the step of supplying the medium 10 to an image recording section. FIG. 2 shows a status in the step of supplying the medium 10 to an image recording section. FIG. 3 shows a status in the step of recording an image on the medium 10 supplied to the image recording section. FIG. 4 shows a status in the step of discharging the medium 10 with the recorded image out of the image recording section.

As shown, the image recording apparatus 1 of the embodiment comprises: a paper cassette 20 placed in the lower right section inside the apparatus 1 for holding the medium 10 before image recording; a drumshaped platen roller 30, placed in the image recording section in the center of the apparatus 1, around which the medium 10 supplied from the paper cassette 20 is wound; a thermal head 40, placed above the platen roller 30, for applying pressure and thermal energy to the medium 10 wound around the platen roller 30; a cam 50 placed in the upper left section in the apparatus 1 for bringing the thermal head 40 close to and away from the platen roller 30 in response to image recording operations; and a discharge slot 60, placed above the paper cassette 20, through which the medium 10 after image recording is discharged. The thermal head 40 includes a plurality of heating elements arranged in a row or a plurality of rows corresponding to pixels. The thermal head 40 corresponds to an application means for applying thermal energy and pressure of the invention.

Inside the apparatus 1, a paper feed arm 21 is provided at the bottom of the paper cassette 20, for lifting the medium 10 in the paper cassette 20 upward. Inside the apparatus 1, supply rollers 22 and 23 are placed in the path between the paper cassette 20 and the platen roller 30. The supply rollers 22 and 23 supply the medium 10 (FIG. 2) lifted upward by the arm 21 from the paper cassette 20 towards the platen roller 30. A transport roller 24 is placed above the supply roller 23, being brought to contact with the supply roller 23 in response to transport operations. Furthermore, a first sensor 25 and a supply guide 26 are provided in the path between the supply roller 23 and the platen roller 30. The first sensor 25 detects the medium 10 being transported. The guide 26 guides the medium 10 detected by the first sensor 25 towards the platen roller 30.

The platen roller 30 may be made up of a metal cylinder around which an elastic body is wound. Achuck 31 is provided on the surface of the platen roller 30, for holding the medium 10 supplied from the paper cassette 20 and guided by the guide 26 to the platen roller 30. A second sensor 32 is provided below the circumference of the platen roller 30. The second sensor 32 detects and determines whether the medium 10 is wound around the platen roller 30. In the upper right section near the circumference of the platen roller 30, a light source apparatus 33 is provided for emitting light for fixing the image onto the medium 10 wound around the platen roller 30. The light source apparatus 33 includes a light source 33Y for emitting light (whose wavelength is 420 nm, for example) onto the medium 10 for fixing a color of yellow and a light source 33M, placed next to the light source 33Y, for emitting light (whose wavelength is 365 nm, for example) onto the medium 10 for fixing a color of magenta.

Inside the apparatus 1, the thermal head 40 is fixed to the right end of a first arm 41 in the shape of delta plate. The left end of the first arm 41 is coupled to the right end of a second arm 43 in the shape of delta plate by means of a spring 42. The lower ends of the first arm 41 and the second arm 43 are supported by a support axis 44. The first arm 41 and the second arm 43 are pivotable around the support axis 44. The left end of the second arm 43 is coupled to the cam 50.

Inside the apparatus 1, the cam 50 includes a rotating plate 51 having a specific curved groove 51*a* to be a cam driver and a roller 52 coupled to the left end of the second arm 43 to be a cam follower that pairs up with the curved groove 51*a* of the rotating plate 51. In the state before image recording (FIG. 1 and FIG. 2), the cam 50 has the second arm 43 coupled to the roller 52 rotate clockwise by means of the rotating plate 51 rotating counterclockwise. At the same time, the cam 50 has the first arm 41 coupled to the second arm 43 with the spring 42 rotate clockwise. The thermal head 40 fixed to the first arm 41 is thereby brought to contact with the medium 10 wound around the platen roller 30 (FIG. 3). Application of thermal energy and pressure by the thermal head 40 to the medium 10 is thus allowed. In the state during image recording (FIG. 3), the cam 50 has the second arm 43 rotate counterclockwise by means of the rotating plate 51 rotating clockwise. At the same time, the cam 50 has the first arm 41 rotate counterclockwise. The thermal head 40 fixed to the first arm 41 is thereby brought away from the medium 10 wound around the platen roller 30 (FIG. 4). Application of thermal energy and pressure by the thermal head 40 to the medium 10 is thus stopped.

Inside the apparatus 50, discharge rollers 61 and 62 are provided in the transport path between the discharge slot 60 and the platen roller 30. The discharge rollers 61 and 62 introduce the medium 10 after image recording to the discharge slot 60. In the transport path between the discharge rollers 61 and 62 and the discharge slot 60, a discharge guide 63 is provided for guiding the medium 10 wound around the platen roller 30 to the discharge slot 60. The discharge roller 62 is made up of two rollers one of which pairs up with the discharge roller 61 and the other of which pairs up with the transport roller 24 so that the medium 10 is discharged out of the discharge slot 60.

Figure 5:
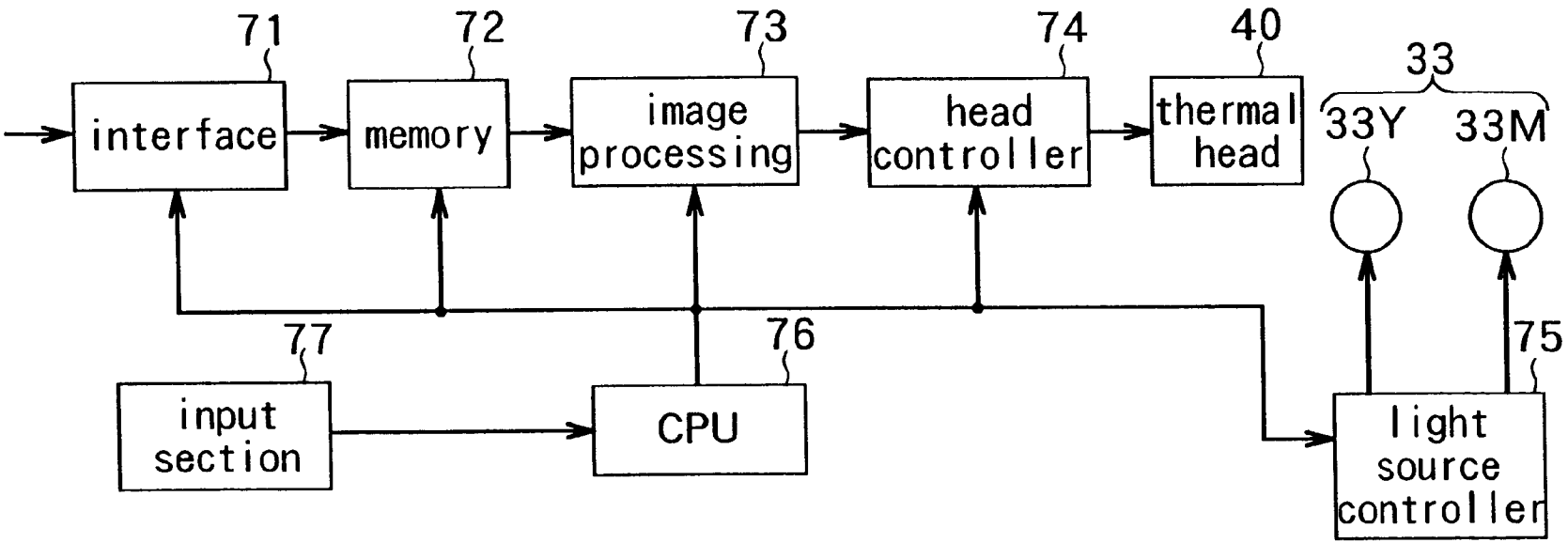
FIG. 5 is a block diagram of a control system of the image recording apparatus of the embodiment of the invention.

Referring to a block diagram of FIG. 5, the control system of the image recording apparatus 1 of the embodiment will now be described.

As shown, the control system of the apparatus 1 of the embodiment comprises: an interface 71 to which various items of image data are inputted from external video equipment and data terminal equipment; a memory 72 where image data inputted to the interface 71 is temporarily stored; an image processing section 73 for performing color adjustment, masking,γ processing and the like on the image data stored in the memory 72; a head controller 74 for performing thermal control on the thermal head 40 based on the image data processed at the image processing section 73; a light source controller 75 for controlling the light source apparatus 33 (the light sources 33Y and 33M) that emits light for fixation onto the medium 10; a central processing unit (CPU) 76 for controlling the control blocks in the apparatus 1; and an input section 77, connected to the CPU 76, for selecting glossiness given to the medium 10 after image recording.

The interface 71 may conform to the SCSI standard. SCSI-compliant data terminal equipment such as a personal computer may be connected to the interface 71.

Alternatively, the interface 71 may conform to any other standard such as the RS-232C, Centronics and R. G. B.

The input section 77 may be a key entry device. The user may choose glossiness as desired from outside the apparatus 1 through key entry.

Figure 8:
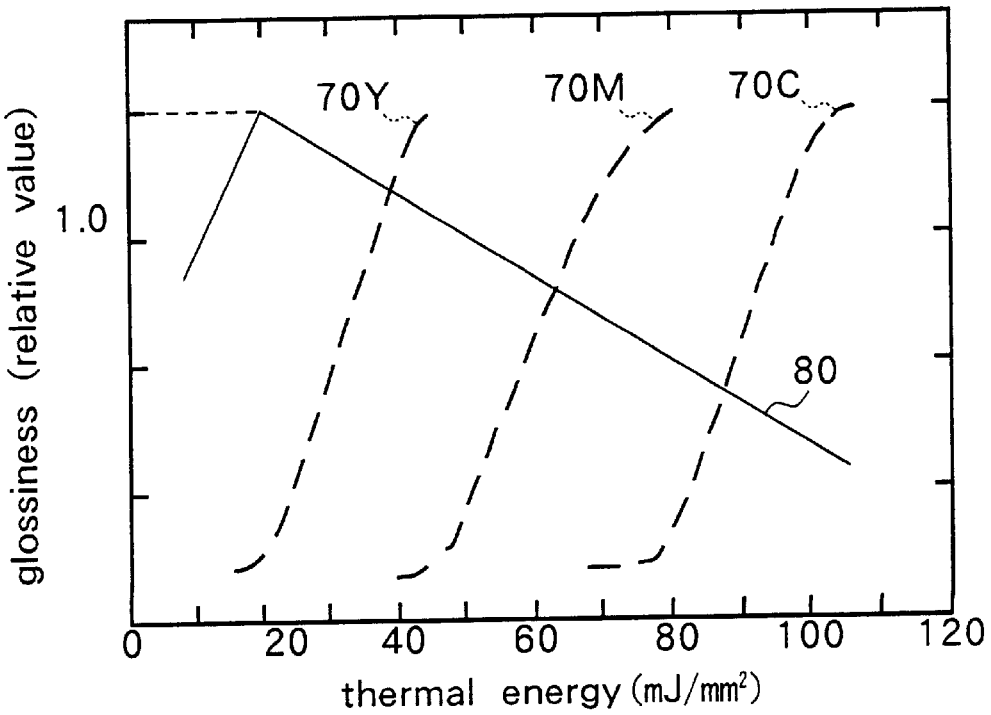
FIG. 8 is a plot for showing gloss characteristics of the heat-sensitive medium shown in FIG. 6.

The CPU 76 includes a memory for storing information (FIG. 7) about thermal energy and color density on the medium 10. During image recording, the CPU 76 controls the thermal head 40 through the head controller 74 so that thermal energy corresponding to the inputted image data is applied to the medium 10. The CPU 76 includes a memory for storing information about thermal energy and glossiness of the medium 10 (FIG. 8). The CPU 76 controls the thermal head 40 through the head controller 74 so that the specific amount of thermal energy and pressure is evenly applied to all the region of the image recording surface of the medium 10 after image recording. The CPU 76 controls the thermal head 40 after image recording so that the thermal energy applied to the medium 10 corresponds to the glossiness selected through the input section 77. The head controller 74, the CPU 76 and the input section 77 correspond to a control means of the invention. The thermal head 40, the head controller 74, the CPU 76 and the input section 77 correspond to the gloss control apparatus of the embodiment.

FIG. 8 is a plot for indicating the gloss characteristics (the relationship between applied thermal energy and glossiness) of the medium 10. The thermal energy scale corresponds to that of the plot of color developing characteristics of FIG. 7. As indicated with numeral 80, the glossiness of the medium 10 first improves with an increase in applied thermal energy. The glossiness reaches the maximum value when applied thermal energy is near the value that allows the yellow layer 14 to start developing a color. The glossiness then decreases with an increase in applied thermal energy.

The gloss characteristics of the medium 10 have the specific relationship as thus described. Glossiness is therefore controllable as desired by varying thermal energy applied to the medium 10. For example, in order to improve glossiness of the image recording surface of the medium 10 to the highest level, the CPU 76 controls the thermal head 40 to apply thermal energy near the value that allows the yellow layer 14 to start developing a color to the medium 10 after image recording. In the embodiment, as thus described, thermal energy applied for improving glossiness falls within the low energy range that allows the yellow layer 14 to start developing a color in order to improve glossiness of the image recording surface to the highest level. Therefore, thermal energy higher than the required amount will not be consumed and process time required for unification and improvement of glossiness is reduced.

The range of thermal energy effective for practical gloss control may be determined such that the minimum energy value is a specific value greater than zero that starts to achieve even glossiness and the maximum energy value is the one that allows development of cyan, for example. Therefore, the substantially effective range of glossiness that is selectable through the input section 77 corresponds to the thermal energy range. The maximum energy value is determined so as to prevent unwanted development of unfixed cyan with an application of thermal energy higher than the value that allows development of cyan.

The reason that glossiness improves with an application of specific pressure and thermal energy by the thermal head 40 is that the recording surface of the medium 10 first softens by the application of thermal energy and the surface is then smoothed by the application of pressure. Glossiness changes by the application of thermal energy since the surface status varies after the thermal head 40 leaves the surface in response to the applied thermal energy.

The gloss characteristics of the medium 10 shown in FIG. 8 are determined through measurement in a specific method in advance. For example, thermal energy in the measurement range is applied to the medium 10 step by step. (The range may be between zero and the value that allows development of cyan to the maximum density.) Glossiness on the surface of the medium 10 thereby obtained is measured with a specific gloss meter. Thermal energy applied for measurement is determined, depending on the resolution of the gloss meter. The specific gloss meter may be an instrument for measuring specular glossiness that is generally used for measuring gloss characteristics of paper (such as photographic paper). For measurement by the instrument for measuring specular glossiness, a luminous flux with a specific incidence angle and a specific aperture angle is introduced onto a sample surface. A luminous flux of a specific aperture angle reflecting in the direction of regular reflection is measured by an appropriate photoreceptor. When thermal energy is applied to the medium 10 for practically achieving evenness and improvement in glossiness, the gloss characteristics of the medium 10 may change depending on the status of image recording on the medium 10 (the status of thermal energy already applied). Therefore, it is preferable to adjust the gloss characteristics of the medium 10 obtained through the method described above, considering the status of image recording on the medium 10.

With reference to FIG. 1 to FIG. 5, the operation of the image recording apparatus 1 of the embodiment will now be described according to the flowcharts shown in FIG. 9 and FIG. 10. The following description applies to the gloss control apparatus and method of the embodiment, too.

First, power is supplied to the image recording apparatus 1 from a power supply means not shown and the apparatus turns on. Image data is then inputted to the interface 71 from video equipment or data terminal equipment and so on (step S101). Key entry is made to select desired glossiness at the input section 77 (step S102). Processing that precedes actual image recording on the medium 10 is then performed. That is, in the control system of the apparatus 1 under the control of the CPU 76, the memory 72 temporarily holds the inputted image data. The image processing section 73 performs color adjustment, masking, γ processing and the like on the image data stored in the memory 72.

As a mechanical operation in the apparatus 1, supply processing is performed for supplying the medium 10 held in the paper cassette 20 (FIG. 1) to the platen roller 30 in the image recording section (step S103). That is, as shown in FIG. 2, the paper feed arm 21 provided at the bottom of the paper cassette 20 lifts the medium 10 in the paper cassette 20 upward. The supply rollers 22 and 23 and the transport roller 24 introduce the medium 10 lifted by the arm 21 towards the platen roller 30. During this procedure, the supply guide 26 guides the tip of the medium 10 to the chuck 31 provided on the surface of the platen roller 30. The chuck 31 then holds the tip of the medium 10. The medium 10 thus held by the chuck 31 is wound around the platen roller 30 through rotation of the platen roller 30.

Having received the image data at the interface 71 and key entry for selecting desired glossiness from the input section 77 and performed the specific processing that precedes image recording as described above, actual image recording processing is performed on the medium 10 (step S104). That is, as a mechanical operation in the apparatus 1, as shown in FIG. 3, the thermal head 40 fixed to the first arm 41 is brought into contact with the medium 10 wound around the platen roller 30 by the action of the cam 50. The thermal head 40 then applies thermal energy corresponding to the image data to the medium 10. The image is thereby recorded on the medium 10.

Figure 10:
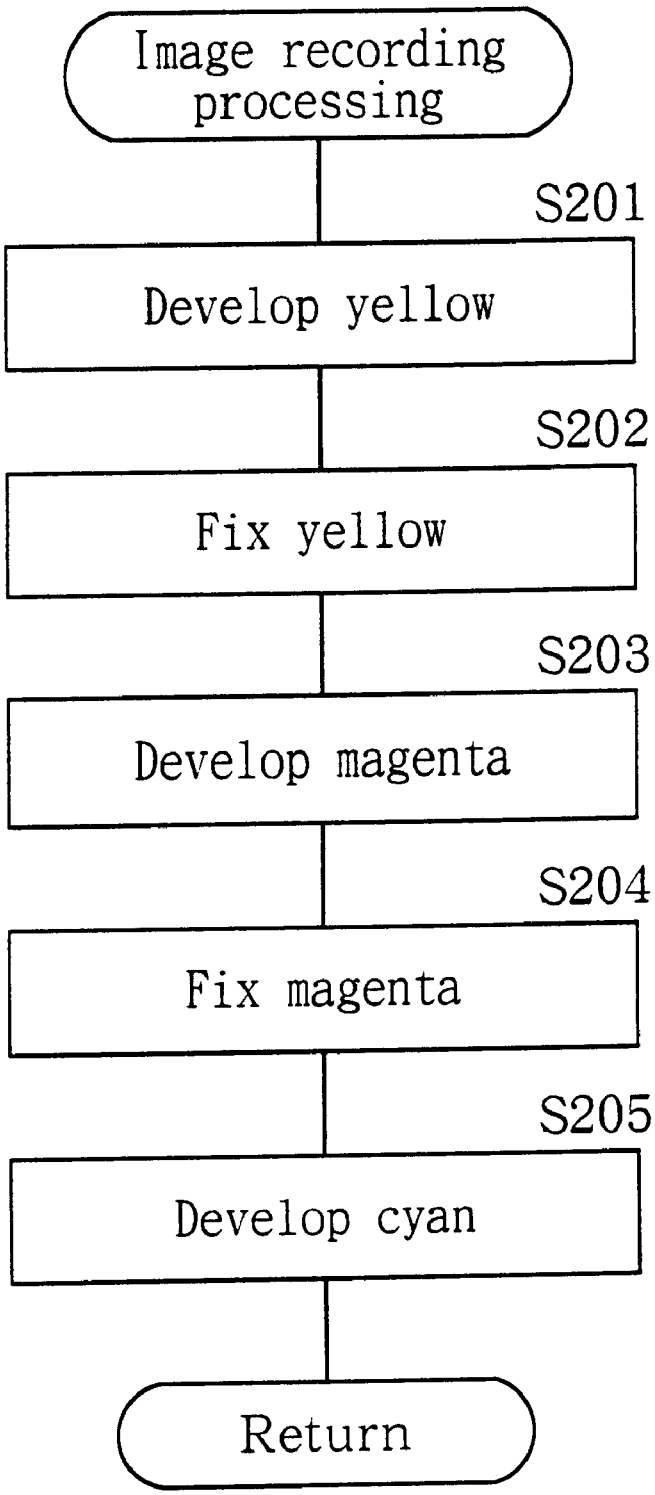
FIG. 10 is a flowchart of an operation of the image recording apparatus of the embodiment of the invention.

FIG. 10 is a flowchart for describing the image recording processing performed in step S104 in detail. As shown, the apparatus 1 performs processing for developing a color in part of the inputted image data corresponding to yellow (step S201). To be specific, the medium 10 held by the chuck 31 rotates to be wound around the platen roller 30. At the first rotation of the medium 10, the thermal head 40 applies thermal energy to the medium 10 for having the yellow layer 14 develop a color. In this processing, in the control system of the apparatus 1 shown in FIG. 5, the CPU 76 controls the thermal head 40 through the head controller 74 so that thermal energy is applied to the medium 10 for developing a color in part of the image data corresponding to yellow. This control performed by the CPU 76 is based on information about thermal energy and color density of each color of the medium 10 stored in the internal memory.

At the first rotation of the platen roller 30, the light source 33Y emits light whose wavelength is 420 nm, for example, to the medium 10 immediately after the color of yellow is developed so that the color is fixed (step S202). In the control system of the apparatus 1 shown in FIG. 5, the CPU 76 controls the light source 33Y through the light source controller 75 so that the light source 33Y emits light for fixing the yellow with specific timing.

Next, the second rotation of the platen roller 30 is effected and the apparatus 1 performs processing for developing a color in part of the inputted image data corresponding to magenta (step S203). The processing is performed by the thermal head 40 applying thermal energy to the medium 10 for having the magenta layer 13 develop a color. In the processing, in the control system of the apparatus 1 shown in FIG. 5, the CPU 76 controls the thermal head 40 through the head controller 74 so that thermal energy is applied to the medium 10 for developing a color in part of the image data corresponding to magenta. This control performed by the CPU 76 is based on information about thermal energy and color density of the medium 10 stored in the internal memory.

At the second rotation of the medium 10, the light source 33M emits light whose wavelength is 365 nm, for example, to the medium 10 immediately after the color of magenta is developed so that the color is fixed (step S204). In the control system of the apparatus 1 shown in FIG. 5, the CPU 76 controls the light source 33M through the light source controller 75 so that the light source 33M emits light for fixing the magenta with specific timing.

Having performed fixation of yellow and magenta as thus described, at the third rotation of the platen roller 30, the apparatus 1 performs processing for developing a color in part of the inputted image data corresponding to cyan (step S205). The processing is performed by the thermal head 40 applying thermal energy to the medium 10 for having the cyan layer 12 develop a color. In the processing, in the control system of the apparatus 1 shown in FIG. 5, the CPU 76 controls the thermal head 40 through the head controller 74 so that thermal energy is applied to the medium 10 for developing a color in part of the image data corresponding to cyan. This control performed by the CPU 76 is based on information about thermal energy and color density of the medium 10 stored in the internal memory.

Figure 9:
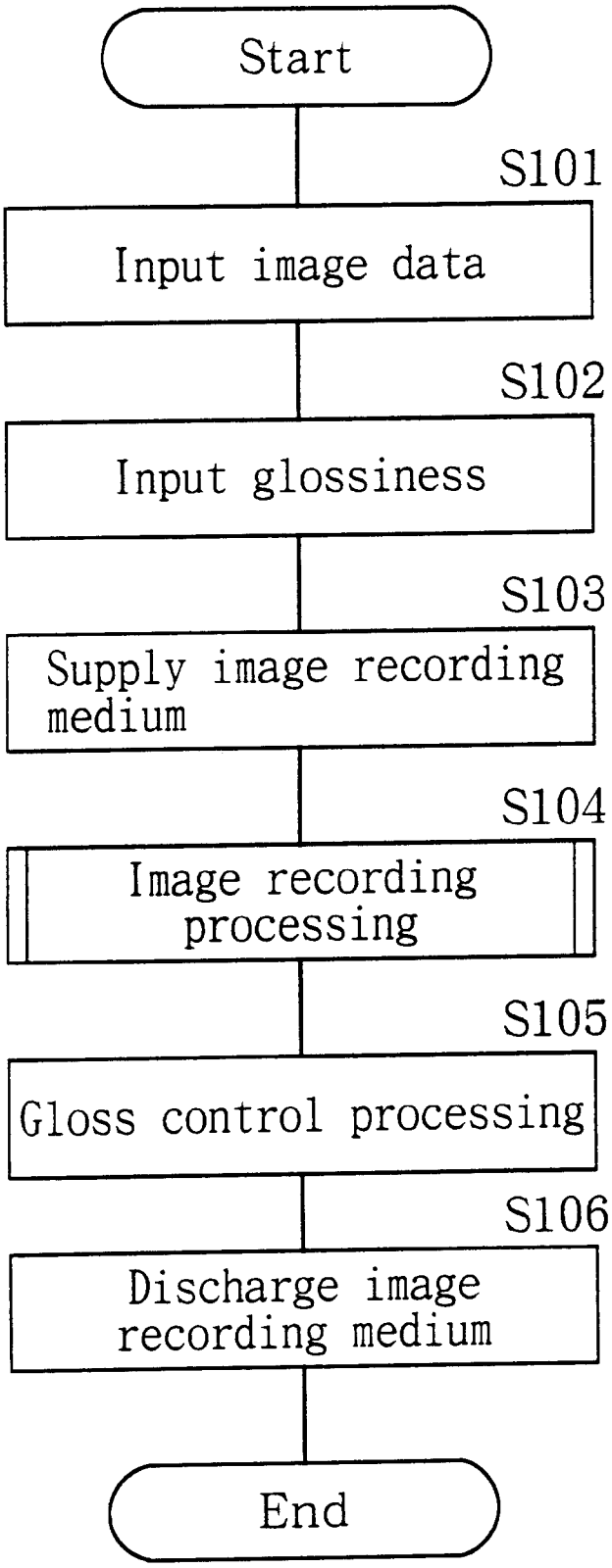
FIG. 9 is a flowchart of an operation of the image recording apparatus of the embodiment of the invention.

Having completed the actual image recording processing by performing steps S201 to S205, the apparatus 1 shifts to processing for gloss control of the medium 10 (step S105) as shown in FIG. 9. At the fourth rotation of the platen roller 30 after developing cyan, the gloss control is performed by the thermal head 40 applying a specific pressure and thermal energy to the medium 10. The thermal energy applied corresponds to the glossiness received through key entry from the input section 77. In the control system of the apparatus 1 shown in FIG. 5, the CPU 76 determines the thermal energy corresponding to the entered glossiness based on information about thermal energy and glossiness of the medium 10 stored in the internal memory. The CPU 76 controls the thermal head 40 through the head controller 74 so that the determined thermal energy and pressure is evenly applied all over the image recording surface of the medium 10 on which the image has been recorded. For example, if selection is made in step S102 for achieving the highest level of glossiness of the medium 10, the CPU 76 controls the thermal head 40 so that thermal energy near the value that allows the yellow layer 14 to start developing a color is applied to the medium 10. The specific pressure applied by the thermal head 40 may be 10 kg per width if the medium 10 is an A4-size sheet of 210 mm in width. In this case, the local pressure is about 48 g/mm.

Next, the apparatus 1 performs processing for discharging the medium 10 (step S106). As shown in FIG. 4, the thermal head 40 fixed to the first arm 41 is brought away from the medium 10 wound around the platen roller 30 by the action of the cam 50. While the platen roller 30 is rotating, the chuck 31 releases the tip of the medium 10 immediately before the discharge guide 63. The discharge guide 63 rotates and shifts towards the platen roller 30 so that the medium 10 wound around the platen roller 30 is introduced to the discharge slot 60. The medium 10 is further transported by the discharge rollers 61 and 62 and the transport roller 24 to be discharged through the discharge slot 60. The entire operation of the apparatus 1 is thus completed.

According to the image recording apparatus 1 of the embodiment described so far, thermal energy and pressure is evenly applied to all over the image recording surface of the medium 10 on which the image has been recorded. As a result, even glossiness is obtained all over the image recording surface. Furthermore, desired glossiness is selectable from outside the apparatus 1 through key entry at the input section 77. The CPU 76 determines the thermal energy corresponding to the entered glossiness based on gloss characteristic information about thermal energy and glossiness of the medium 10 stored in the internal memory. The CPU 76 controls the thermal head 40 through the head controller 74 so that the determined thermal energy is evenly applied to all over the image recording surface of the medium 10 on which the image has been recorded. Evenness of glossiness of the medium 10 after image recording is thus achieved so that the glossiness the user desires is obtained. For example, if selection is made for achieving the highest level of glossiness of the medium 10, the CPU 76 controls the thermal head 40 so that thermal energy near the value that allows the yellow layer 14 to start developing a color is applied to the medium 10. Even glossiness of the highest level is thereby achieved. In this case, thermal energy applied for improving glossiness falls within the low energy range that allows the yellow layer 14 to start developing a color. Therefore, thermal energy more than the required amount will not be consumed and process time required for unification and improvement of glossiness is reduced. The CPU 76 thus controls thermal energy to apply so that the desired glossiness falls within the specific range including the highest glossiness with regard to the gloss characteristics of the medium 10. According to the image recording apparatus 1 of the embodiment described so far, even glossiness of the image recording surface of the heat-sensitive recording medium on which an image has been recorded is achieved. The glossiness is controllable as desired as well.

According to the image recording apparatus 1, the thermal head 40 for image recording is used as the means for applying thermal energy and pressure for achieving even glossiness as well. As a result, thermal energy to apply is precisely controlled and application of thermal energy more than the required amount will be prevented. Power consumption is thereby restrained. Process time and thermal energy required for achieving even glossiness are thereby reduced as well. Costs are further reduced since no additional components are required for achieving even glossiness.

The invention is not limited to the foregoing embodiment but may be practiced in still other ways. Although the image recording apparatus is described in detail in the embodiment, the invention is applicable to an apparatus for recording texts, patterns and so on. Although the heat-sensitive recording medium 10 for full-color printing made up of stacked three layers developing cyan, magenta and yellow is described in the foregoing embodiment, the invention is not limited to such a medium but may be applied to recording on any other multicolor recording medium or single-color recording medium that develops cyan only, for example.

In the foregoing embodiment the CPU 76 determines the thermal energy corresponding to the selected glossiness and controls the thermal head 40 so that the determined thermal energy is applied to the medium 10, based on the gloss characteristics of the medium 10 as shown in FIG. 8. However, the invention may be applied to a heat-sensitive recording medium having the gloss characteristics other than those shown in FIG. 8. In this case, based on the gloss characteristics specific to the medium, the CPU 76 determines the thermal energy corresponding to the selected glossiness and controls the thermal head 40 so that the determined thermal energy is applied to the medium 10. Through such control, glossiness is controlled in accordance with various types of heat-sensitive recording media.

Although the CPU 76 retains information about thermal energy and glossiness of the medium 10 (FIG. 8) and controls thermal energy so as to obtain desired glossiness, the CPU 76 may not have the information. In this case, the parameters corresponding to thermal energy are inputted through the input section 77. The CPU 76 controls thermal energy in accordance with the parameters.

Obviously many modifications and variations of the present invention are possible in the light of the above teachings. It is therefore to be understood that within the scope of the appended claims the invention may be practiced otherwise than as specifically described.

What is claimed is:

1. A gloss control apparatus for controlling glossiness of an information recording surface of a heat-sensitive recording medium developing at least one color in response to thermal energy applied thereto corresponding to an input image, comprising:

an input section for use by a user of the apparatus to select a desired glossiness of the information recording surface and producing a desired gloss signal;

application means for applying thermal energy and pressure to the information recording surface of the heat-sensitive recording medium having information recorded thereon; and control means for controlling the thermal energy applied by the application means based on the desired gloss signal from the input section and on stored gloss versus thermal energy characteristics of the heat-sensitive recording medium, so that the desired glossiness of the information recording surface recorded with the information is obtained.

2. The gloss control apparatus as set forth in claim 1, wherein the control means controls the thermal energy applied to the information recording surface so that the predetermined glossiness is within a specific range including highest glossiness with regard to the stored gloss characteristics of the heat-sensitive recording medium.

3. The gloss control apparatus as set forth in claim 2, wherein the heat-sensitive recording medium includes a first layer for developing a color of yellow, a second layer for developing a color of magenta and a third layer for developing a color of cyan, and a thermal energy approximately equal to a thermal energy value allowing the first layer to start developing the color of yellow is applied so that the desired glossiness is obtained.

4. The gloss control apparatus as set forth in claim 1, wherein the application means comprises a thermal head for recording the information on the information recording surface.

5. The gloss control apparatus as set forth in claim 1, wherein the heat-sensitive recording medium includes a first layer for developing a color of yellow, a second layer for developing a color of magenta and a third layer for developing a color of cyan, and a maximum value of the thermal energy applied under control of the control means is approximately equal to a thermal energy value allowing the third layer to start developing the color of cyan.

6. A gloss control method for controlling glossiness of an information recording surface of a heat-sensitive recording medium developing at least one color in response to thermal energy applied therto, comprising the steps of:

storing gloss versus thermal energy characteristics of the heat sensitive recording medium;

inpputting a desired glossiness of the information recording surface using a user activated input section;

determining the themal energy to be applied to the information recording surface based on the desired glossiness input by the user and the stored gloss characteristics of the heat-sensitive recording medium for obtaining the desired glossiness of the information recording surface having information recorded thereon; and controlling the thermal energy applied to the information recording surface recorded with the information so that the determined thermal energy is applied to the information recording surface to obtain the desired glossiness.

* * * * *